United States Patent [19]

Eickmann

[11] Patent Number: 4,690,620

[45] Date of Patent: Sep. 1, 1987

[54] VARIABLE RADIAL PISTON PUMP

[76] Inventor: Karl Eickmann, 2420 Isshiki, Hayama-machi, Kanagawa-ken, Japan

[21] Appl. No.: 714,225

[22] Filed: Mar. 20, 1985

Related U.S. Application Data

[60] Continuation-in-part of Ser. No. 429,746, Sep. 30, 1982, abandoned, which is a division of Ser. No. 179,420, Aug. 19, 1980, Pat. No. 4,475,870.

[51] Int. Cl.[4] ..... F04B 27/04

[52] U.S. Cl. ..... 417/273; 417/286; 137/115

[58] Field of Search ..... 417/286, 270, 273; 137/115

[56] References Cited

U.S. PATENT DOCUMENTS

| | | | |
|---|---|---|---|
| 658,566 | 9/1900 | Deems | 137/625.48 |
| 2,074,618 | 3/1937 | Roeder | 137/115 |
| 2,696,788 | 12/1954 | Funston | 417/304 |
| 2,878,753 | 3/1959 | Adams et al. | 137/115 |
| 2,887,060 | 5/1959 | Adams et al. | 137/115 |
| 3,561,327 | 2/1971 | Stremple | 137/115 |
| 3,874,271 | 4/1975 | Eickmann | 91/491 |
| 4,237,993 | 12/1980 | Jablonsky | 417/286 |
| 4,257,750 | 3/1981 | Dantlgraber | 417/270 |

*Primary Examiner*—Leonard E. Smith

[57] ABSTRACT

A hydraulic arrangement has a housing which includes a first space of a definite first pressure and a second space with a lower second pressure. A primary pump supplies fluid under the first pressure into the first space to open the entrance ports into cylinders, which contain pistons therein, whereby the pistons are forced partially out of the cylinders and into the mentioned second space. In the second space the pistons are moved inwardly into the cylinders by an eccentric cam ring to supply a flow of fluid of a fourth pressure out of the outlet of the arrangement's housing. In modified embodiments the arrangement is a pressure transmission, which takes in a third pressure to drive a motor in the arrangement which in turn drives the shaft with the eccentric cam and the unit then exits the fourth pressure, which might be a very high pressure of up to more than ten thousand pounds per square inch. Still other embodiments show in several modifications a device to reciprocate or oscillate exterior linear or rotary motors either permanently or stepwise in predetermined cycles. Working actions of machines or vehicles can so be driven and controlled by the arrangement without additional control facilities, when so desired. A valve arrangement elects different pressures for different quantities of flow of fluid.

5 Claims, 6 Drawing Figures

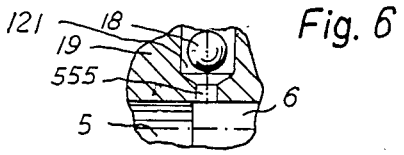
Fig. 6
Fig. 5
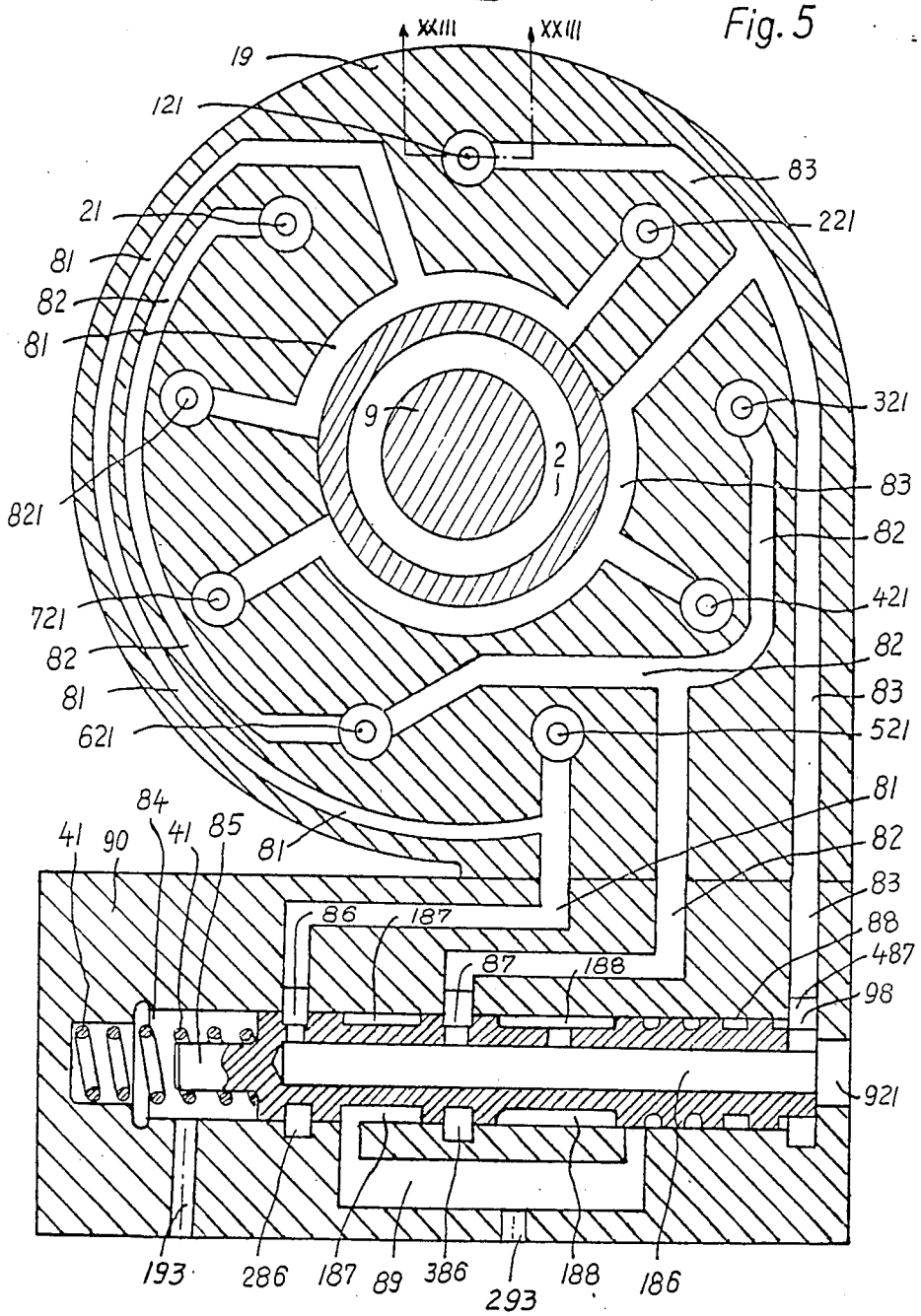

VARIABLE RADIAL PISTON PUMP

REFERENCE TO RELATED APPLICATIONS

This is a continuation in part patent application of my application Ser. No. 429,746 now abandoned, which was filed on Sept. 30, 1982 as a divisional application of my still earlier appplication Ser. No. 179,420 which was filed on Aug. 19, 1980 and which issued as U.S. Pat. No. 4,475,870 on Oct. 9, 1984.

BACKGROUND OF THE INVENTION (1) Field of the Invention:

This invention relates to hydraulic arrangements such as pumps, motors or transmissions and may even include some control devices. The invention uses a novel arrangement to obtain novel effects, like a pressure transmission, a very high pressure fourth pressure stage exceeding, if desired, ten thousand pounds per square inch, automatic reciprocation, vibration, step advances or rotary steps of exterior linear or rotary hydraulic motors or others. Partially known elements of the former art or if of my earlier patents may be included in the novel arrangement if so desired or if of special value.

(2) Description of the Prior Art:

At this present time of filing this application there is no former art of the main aims of the invention known to the applicant. Also there are no arrangements known presently to the applicant which would correspond to the arrangement of the invention.

However, as applicant sees it, there are a great number of efficient hydraulic pumps, motors and transmissions available, which as pumps supply one or more flows of fluid, as motors are driven by a fluid flow from a hydraulic pump and as transmissions combine a pump and motor in a single unit.

Some of them are my own elder patents and they are very effective and powerful. For example; my following elder patents: U.S. Pat. Nos. 2,975,716; 3,158,103; 3,223,046; 3,277,834; 3,398,698; 3,831,496; 3,850,201; 3,889,577; 3,960,060; 3,951,047; 4,212,230; 3,874,271 and others.

As far as motors or first pumps are used in the arrangement of the invention, these patents might be utilized in part in the invention or some of these patents may also be used entirely in a portion of the arrangement of the present invention. The last mentioned patent already uses the cam of the second space of this invention, however the piston shoes and piston of this elder patent fail to reach the high efficiency and pressure of this present invention. Moreover the mentioned patent partially failed because it did not take efficiently care of the required first and second spaces of the invention with the therein required first and second pressures.

(3) Limitations of the Prior Art:

The usual pump of the former art delivers a flow of fluid of permanent rate of flow. The control of the directional changes of pistons in external cylinders is commonly done by control valves. Plural flow pumps with equal rates of flow in different flows can do directional changes of external pistons, when they are equally variable, but the directional controls are then usually not very fast and not exactly volumetrically determined. Thus, they are not very good in vibrating or oscillating external pistons rapidly at high frequencies.

When hydraulic motors would drive highest pressure pumps to create a highest fourth pressure flow, they would require clutches between motor and pump and fastening housings to connect them. Their weight would exceed several times the weight of the arrangement of the invention, when present market pumps and motors would be used.

The pump of my U.S. Pat. No. 3,874,271 failed to set a disloading passage to the space, wherein the eccentric cam revolved or wherein the outer piston shoes moved. That resulted therein, that after a short time of operation the leakages which escaped through the fitting clearance between the outer face of the piston and the inner face of the cylinder, the space wherein the cam or the piston shoes moved, filled up with a higher pressure and finally the pressure in this respective space became equal to the pressure of the pressure in the high-pressure cylinder or at least it exceeded the pressure which was supplied by the supercharger pump. The consequence thereof is, that the piston could not move any more under the pressure supplied from the first pump or from the supercharger pump. The piston just remained finally in a stationary position and the high pressure pump became unable to deliver any pressure fluid, because the piston did not sufficiently reciprocate.

The pump of U.S. Pat. No. 3,874,271 also failed to give enough long piston shoe stroke and the piston stroke also failed to operate at the somtimes required very high fourth pressure of the invention, because the piston shoe extensions and the recess-portions which should extend beyond the outer end or the innermost end of the cylinder deeper into the respective cylinder block where not long enough. The piston shoes of the mentioned patent also failed to divide the balancing pockets into plural pockets with bearing lands or faces therebetween and thereby they failed to stand at very high pressures without increasing friction.

SUMMARY OF THE INVENTION

The invention attempts to either partially or totally to overcome or reduce the limitations and errors of the former art. In addition the invention aims to provide new hydraulic arrangements for novel operations or to do a novel work or novel works.

The invention also attempts to increase the powers and efficiencies of hydraulic arrangements.

The invention gives in a number of embodiments of the invention a number of solutions for the aims of the invention. These are described and illustrated in great detail in the description of the preferred embodiments and in the Figures of the drawings.

One of the aims and objects as well as solutions of the invention, is as follows:

A hydraulic arrangement, including in combination, a housing, a rotary shaft revolvably borne in said housing, at least one eccentric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring at least indirectly engages to guide at least partially the reciprocation-stroke of said at least one piston when said at least one piston reciprocates in said at least one cylinder, wherein said at least one entrance port, cylinder, piston and exit port are pluralities and said exit ports include one-way valves and are communicated to separated outlets of said at least one outlet respectively and separately, wherein at least one control valve is provided on said housing, wherein at least two of said separated outlets supply fluid of a fourth pressure through said control valve to a respective final outlet, wherein said control valve is subjected to an automatic control action when said fourth pressure exceeds the fourth pressure range while said control action closes at least one of said at least two separated outlets and communicates it to a space under substantial low pressure to continue the fluid flow supply of the remaining at least one separated outlet with a fifth pressure higher than said fourth pressure range into said final outlet, whereby in addition to a medial pressure first pump which may supply a first flow, said arrangement supplies stepwise variating high pressure flows with decreasing flow quantity at every increasing pressure in a higher pressure range, and, whereby said arrangement is enabled to supply from a power source of a given power extremely high pressures with reduced flow in relation to said given power of said arrangement.

BRIEF DESCRIPTION OF THE DRAWING

FIG. 5 is a cross-sectional view through still a further embodiment of the invention.

FIG. 6 is a sectional view through FIG. 5 along the line XXIII—XXIII through FIG. 5.

DESCRIPTION OF THE PREFERRED EMBODIMENTS

Figure 1:
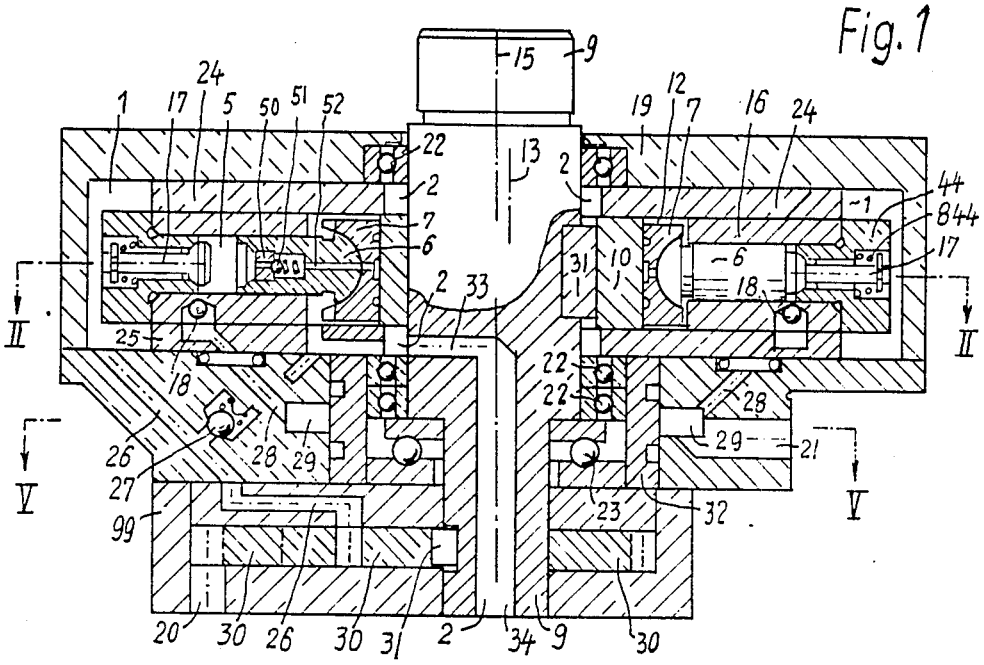
FIG. 1 is a longitudinal sectional view through one embodiment of the invention.

In the Figures, as far as differently pressurized spaces are essential, the reference numbers 1 indicate the first space, 2 the second space, and as far as provided, 3 the third space and 4 the fourth space. The referential numbers 5 indicate the cylinders, 6 the pistons, 7 the piston shoes, 9 the shaft, 10 the first eccentric cam ring, 11 the second eccentric cam ring, 13 and 14 the respective axes of the respective cam ring, 15 the axis of the shaft 9, 16 the cylinder blocks, 17 the entrance port(s), 18 the exit port(s), 19 the housing, 20 the inlet and 21 the outlet.

The embodiments work basically as follows:

An hydraulic arrangement includes in combination, a housing 19, a rotary shaft 9 revolvably borne in the housing 19, at least eccentric cam ring 10 and/or 11 revolving in unison with shaft 9 when the shaft 9 revolves, the mentioned cam ring 10,11 surrounds a portion of the shaft 9 and forms a cylindrical outer face 12 of equal radius 614 around an axis 13, which is parallel to the axis 15 of shaft 19 but distanced therefrom by a first eccentricity or a second eccentricity; at least one cylinder 5 in at least one cylinder block 16 is provided in the mentioned housing 19 whereby the cylinder block 16 is containing at least one cylinder, at least one piston 6, at least partially connecting to at least one entrance port 17, and at least one exit port 18 to pass fluid into and out of the mentioned at least one cylinder 5 when the mentioned at least one piston 6 reciprocates in the at least one cylinder 5. The housing 19 has in its interior at least one first space 1 and at least one second space 2 and is provided with at least one inlet 20 and at least one outlet 21. The first space 1 is sealed and separated from the second space 2. The first space 1 engages the mentioned at least one entrance port 17 and the mentioned outlet 21 communicates to the at least one exit port 18. The mentioned second space 2 surrounds the at least one cam ring 10,11. The mentioned at least one piston 6 is capable of entering at least partially into the mentioned second space 2 and it is engaging at least indirectly the mentioned outer face 12 of the respective cam ring 10,11. The outer face 12 of the respective cam ring 10,11 is thereby at least indirectly engaging to guide at least partially the stroke or reciprocation of the mentioned at least one piston 6 when the shaft 9 revolves and the piston 6 reciprocates in cylinder 5. When the piston 6 not directly engages the outer face 12 of the cam ring 10 or 11, at least one piston shoe 7 is inserted between the piston 6 and the outer face 12 of cam ring 10 or 11.

The first space must at all times of operation be filled with a first pressure which must be sufficiently higher than the second pressure in the second space because the first pressure must be sufficiently high enough to be able to drive the respective pistons at their intake strokes. To maintain the first pressure, the second space must be respectively sealed to the first space. Commonly the first pressure is some atmospheres higher than the second pressure because a unsufficient difference between the first and second pressures would not be able to overcome the friction which the pistons suffer on the walls of the cylinders when the pistons do their intake strokes.

Figure 2:
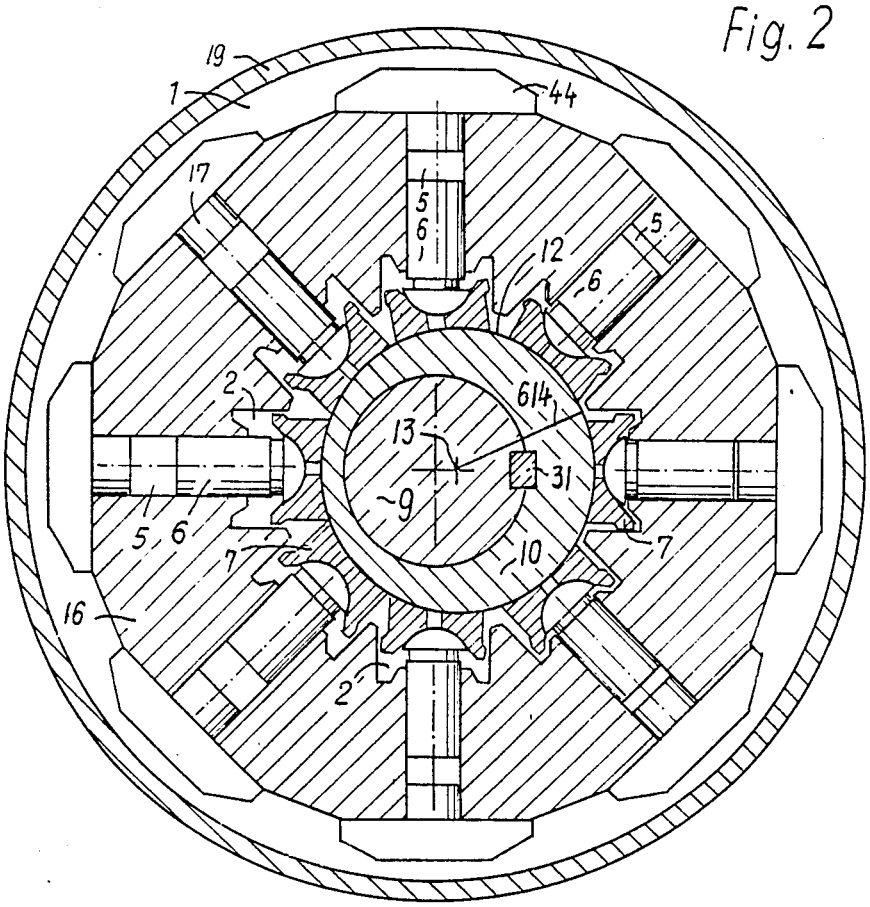
FIG. 2 is a cross-sectional view through FIG. 1 along the line II—II.

Referring now first to FIGS. 1 and 2, the housing 19 carries bearings 22 wherein the shaft 9 is revolvably borne. Thrust bearing 23 bears the end of shaft 9. The first space 1 is located around the cylinder block 16 and filled with fluid of a first pressure by first pump 30, which may also be driven by shaft 9. Inlet 20 leads the fluid to pump 30, which is drawn here as a gear pump but which might in this as well as in others of the figures also be any suitable other pump, for example, internal gear pump, vane pump or fixed or variable piston pump. Key 31 connects the first gear 30 of the pump 30 to shaft 9. First pump 30 delivers the first pressure through passage 26 into the first space 1. The height of pressure in first space 1 may be set by relief valve or pressure limitation valve 27 which communicates with passage 26 and the second space 2, whereby excessive fluid supply from pump 30 flows over valve 27 into the low pressure—or second space 2. The eccentric cam ring 10 is fastened by key 31 to shaft 9. The outer face 12 of cam ring 9 has equal radii around the eccentric axis 10 which is radially displaced from axis 13 of shaft 9 but parallel thereto.

During operation of the hydraulic arrangement of these Figures and similarly in the other Figures, the pressure supplied by pump 30 and built up in the first space 1 as the first pressure, opens the entrance port 17 and presses the piston 6 in cylinder 5 downwards into its bed in the piston shoe 7 and the piston shoe 7 thereby against the outer face 12 of cam ring 9. When the outer face 12 moves away from the cylinder block 16 at one half of the revolution, the cylinder 5 fills up with fluid over inlet port 17. In FIG. 1 inlet port 17 is an inlet valve. At the other half of the revolution the outer face 12 of eccentric cam 10 moves toward the cylinder block 16. Piston show 7 then presses the piston 6 into the respective cylinder 5. The FIGS. 1 and 2 show a plurality of cylinders 5 and pistons 6 in cylinder block 16 and an equal number of piston shoes 7 interposed between the outer face 12 and the respective piston 6. At the inwards stroke of the respective piston 6 the entrance port 17 closes and exit port, in this case exit valve, 18, opens. The fluid is pressed out the the respective cylinder 5 by the respective piston 6 over the exit port 18 and enters into the passage 28 wherethrough it flows into the common collection chamber 29. Each exit valve 18 has a connection to a respective passage 28 and each passage 28 in this Figure ends into the common collection chamber 29. From the common collection chamber 29 the fluid is passed through the outlet 21 out of the arrangement in housing 19.

It is very important, that the first pressure in the first space 1 is high enough to open the inlet ports 17 and high enough to press the pistons 6 downward in the inlet stroke and it is still more important, that the first space 1 is sealed and separated from the second space 2. The second space 2 must be empty of pressure or contain a second pressure which must be substantially lower than the mentioned first pressure. Because if there is too high a pressue in the second space 2 which surrounds the cam ring, 10, piston end of piston 6 and the piston shoe 7, the pistons 6 would not move towards the outer face 12 of the cam ring and the device could then not work. The second space 2 is therefore connected by passage 33 over passage 34 to the outside or to a space under substantially low pressure.

To make the manufacturing of the collection chamber 29 possible, a bush 32 is inserted into housing 19 and it may carry the bearings 22. Bush 32 closes the collection chamber 29 radially inwards. Outlet 21 is communicated to the common collection chamber 29.

In one series of these arrangements which were just completed a few weeks ago, the first pressure was about eight atmospheres, the housing 19 was an aluminum alloy casting, the second pressure was about one atmosphere and the fourth pressure, which is the high pressure supplied out of outlet 21 reached peak pressure of 12,000 (twelve-thousand) psi. The overall efficiency was extremely good and the reasons for the good efficiency will become explained at hand of FIG. 15 which shows the preferred embodiments of entrance port, exit port, piston, cylinder block and piston shoe as well as the cylinder in a greater scale for better visibility in the drawing.

Member 24 in FIG. 1 may be provided, when the cylinder block 16 consists of a plurality of individual blocks and plate 25 may serve also in the same way as member or plate 24 to hold separated blocks 16 radially together by common pins in common seats. But plate 25 may in addition facilitate the provision of spring seats for the exit ports or exit valves 18 and it may also serve to make the machining of passages 28 and the connection portions of passages 28 easier.

FIG. 2 is the section through FIG. 1 along line II—II and shows the location of the plurality of cylinders, pistons and piston shoes respectively and in respect to the cam ring 10. The configuration of the section through cam ring 10 is also shown in FIG. 2.

The radius of the piston head, which enters into the complementary formed seat in piston shoe 7 depends on the pressure desired and is also a matter of knowledge and experience. The inner diameters of the unloading recesses should only very slightly exceed the diameter of the respective piston 6.

Figure 3:
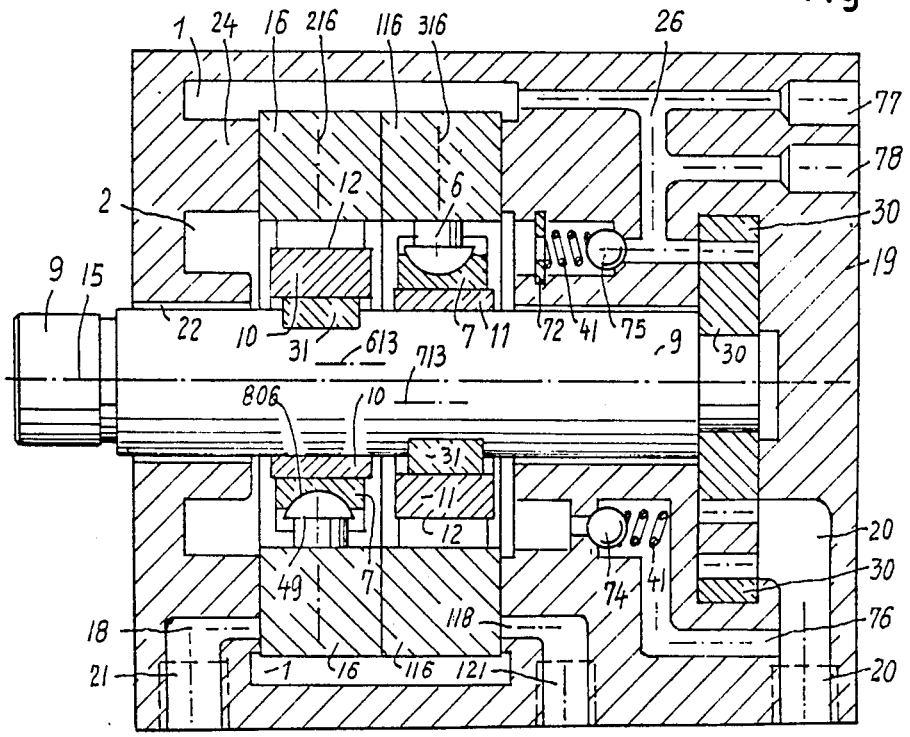
FIG. 3 is a longitudinal sectional view through another embodiment of the invention.

In FIG. 3 the next embodiment of the invention is demonstrated in a longitudinal sectional view. It differs from FIG. 1 mainly therein, that not a single eccentric cam ring 10 is provided, but a plurality of eccentric cam rings 10 and 11. Each of the cam rings is associated to a respective cylinder set 16 or 116. In FIG. 3 the plurality of cylinder blocks, 6,16,116 is located axially one after the other. The cam rings 10 and 11 are also axially behind each other located. In this embodiment the plurality consists of cylinder blocks 16,116 with plural individual cylinders each, as in FIGS. 1, 2. The number of eccentric cam rings 10,11 should be equal to the number of cylinder block center faces 216,316 and the center faces 216,316 should substantially be equal to the respective medial radial faces of the cam rings 10,11. The plural cam rings 10,11 may have different eccentric axes or equal eccentric axes. In the Figure, which has two blocks 16,11 and 2 cams 10 and 11, the cam 11 is 180 degrees turned angularily relative to cam ring 10. The respective keys 31 show their fastening against rotation on shaft 9. In the Figure cam ring 10 shows the wider portion to the top of FIG. 3 and around eccentric axis 613, while cam ring 11 shows its bigger portion downward and around the eccentric axis 713, whereby the eccentric axes 613 and 713 are located diametrically oppositely respective to the axis 15 of shaft 9. In the case of application of three cam rings they may be turned 120 degrees relative to each other, in case of application of five rings they may be turned 72 degrees relative to each other and so on.

The feature of the arrangement of FIG. 3 is specifically, that plural flows are supplied from the device when so desired and that single flow can be set to act at equal times with equal volumes. This will be explained more in detail in connection with some of the later Figures.

Otherwise also this Figure has a first pump 30, in this case an internal gear pump, which suctions fluid through inlet 20 and delivers it into the first space 1 through passage 26. An first space pressure limitation—or overflow—valve 75 may be set between passage 26 and the second space 2 and be loaded by spring 41 which may be held by retainer 72. The second space 2 may in this or in other Figures also obtain a low-pressure setting valve 74 with loading spring 41 to overflow into inlet 20 through passage 76. The feature of this valve is to keep a certain fluid under relatively low pressure and in any case under substantially lower pressure than the first pressure in the first space 1 is inside of space 2 in order to maintain a lubrication of all faces in the second space 2.

FIG. 3 also shows, that outlets 77 and/or 78 may be extended from passage 26 through housing 19 in order to permit the exit of fluid of the first pressure out of the arrangement to do work on places external of the housing 19 of the arrangement, when the first pump 30 is sufficiently dimensioned to supply enough first pressure fluid. The members 24 and 25 of FIG. 1 are in this present FIG. 3 integral portions of housing 19 and keep the cylinder blocks 16 and 116 closely fitted between portions 24 and 25. When so desired, a medial plate might become inserted between blocks 16 and 116, but such plate is not drawn in FIG. 3. But it is demonstrated as plate 80 in FIG. 6.

All pistons 6 of both cylinder blocks 16 116 or of the plurality of cylinder blocks may deliver the respective fluid into a common collection chamber 29 as in FIG. 1. But that is not demonstrated in FIG. 3. In FIG. 3 it is however demonstrated, that each cylinder block may deliver into a common collection chamber 18 of the respective cylinder block. But there is still another possibility demonstrated in FIG. 3, namely that each individual piston 6 may deliver into an individual outlet 21,121 over the respective exit port 18.

While FIG. 1 had exit valves 8 as exit ports, the exit ports 18 in the bottom of FIG. 3 have no exit but only single exit ports which end directly into the respective outlets 21 or 121. It is important however, to note, that these ports 18 are not a must, but that instead the outlet valves 18 of FIG. 1 could be provided in FIG. 3 if so desired. The piston shoes 7 are shown in simplified sectional views without balancing and unloading recesses in this Figure and the portions of the pistons 6 which extend from the blocks 16,116 into the second space 2 are shown in outside views in this Figure.

Figure 4:
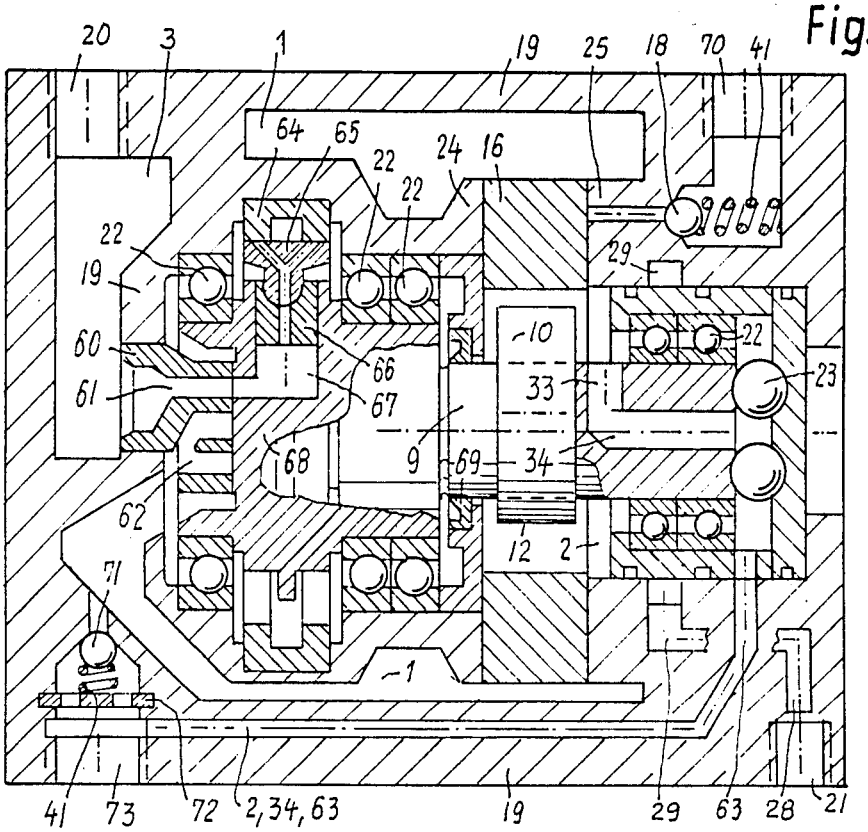
FIG. 4 is a longitudinal sectional view through a further embodiment of the invention.

The embodiment of the invention contained in the arrangement of FIG. 4 is commonly utilized as a pressure transmission. Several machines or vehicles, for example ships, aircraft, power shovels, trucks and the like commonly have a basic pressure source or pump of medial or limited higher pressure, for example 3000 to 5000 psi. But at locations remote from the basic pressure source there are occasionally very high pressures desired, for example, 5000 to 15,000 psi. It is then very economical in investment and practice in application to set the pressure transmission of FIG. 4 at the place close to the required high-pressure operation.

Inlet 20 of FIG. 4 is then communicated to the fluid line which carries the basic pressure from the commonly available basic fluid pressure source in the vehicle or machine. The said basic pressure fluid enters the third space 3 in housing 19 as the third pressure. From space 3 the third pressure fluid flows through control body 60 and through control port 61 into the respective cylinders 67 of hydraulic motor 68. Thereby the pistons 66 are moved outward in the cylinders 67 and are running with associated piston shoes along the piston stroke guide 64. Thereby the motor 68 is revolved and supplies the rotary motion and power to shaft 9 to revolve shaft 9 and to drive the cam ring(s) 10,(11) around. When the third pressure fluid flow has set the fluid motor 68 into rotation and maintain the respective time of rotation, the fluid leaves the respective expelling cylinders 67 through the exit passage 62 of control body 60 and flows then into the first space 1.

First space 1 is separated from second space 2 by the seal 69 in housing inner portion 24. And the third space 3 is sealed from the first space 1 by the control body 60 in the respective housing portion of housing 19. The fourth pressure space is the common collection chamber 29 and a fifth space may be one or more single outlets 70. The first space 1 contains the first pressure, which is the oulet pressure of the motor 68, the second space is the low pressure space 2 and contains the second pressure 2 of substantially lower pressure than the first pressure in the first space 1. The first space 1 may have a pressure limitation or overflow valve 71 loaded by spring 41 and held by retainer 72 to let the overflow escape into the second pressure space 2 and its outlet 73.

The rotor 68 of motor 68 may be borne in radial bearings 22 and so may be the shaft 9 which is integral or common to motor 68 and eccentric cam 10. The axial load may be carried by thrust-bearing 23. Similar radial bearings 22 may be assembled in the bush 32 which is alread known from FIG. 1. For obtaining a good efficiency, high power at the cost of little wight, it is recommended to use as motor 68 and as control body 60 one or the other of my known U.S. Pat. Nos. 2,975,716; 3,158,103; 3,223,046; 3,277,834, 3,398,698; 3,831,496; 3,850,201; 3,889,577; 3,960,060; 3,951,047; 4,212,230 or others.

Cylinder block 16 is contained between housing portions 24 and 25 as known from the already discussed Figures and it contains at least partially the cylinders 5, the pistons 6, the entrance ports 17, the exit ports 18 and the piston shoes 7 are interposed between the respective pistons 6 and the outer face 12 of eccentric cam 10 as also known from the other Figures and as not shown in FIG. 4, because it is already explained at hand of the former Figures. The second space with its substantial lower second pressure communicates through passages 33,34,36 with low pressure outlet 73 which may connect to the entrance passage of the basic power source or to the fluid tank of the machine or vehicle.

The highest pressure or fourth pressure is the pressure in the fourth space which is the common collection chamber 29 which is known from the discussion of the earlier discussed Figures. It is in this embodiment connected to a plurality of single exit valves 18 of respective cylinders 6. It supplies the fourth or highest pressure of for example 4000 to 15,000 psi out of outlet 21 via passage 28 as already known from earlier Figures. If so desired, the outlet pressure may however also be less than 4000 psi. If so desired one or more separated outlets 70 may be provided to single or combined other exit ports or exit valves of other cylinders 5. They may exit a fifth pressure out of the fifth space 70 through outlet 70. An exit valve 18 with spring 41 may be respectively provided in the respective exit passage and outlet 70 or therebetween. The pressure flows supplied out of outlet 21 or out of outlet 70 are effectively capable for highest pressure work at the desired remote place in the vehicle or machine without installation of any other or highest pressure pump or source beside of the device of FIG. 4.

FIG. 5 is a cross-sectional view through the delivery passage portion of any suitable pump of the Figures of this application. For example, through the delivery passage portion of FIG. 4. Or the housing portion of FIG. 5 is mounted onto the end of the housing of such a pump.

The arrangement of FIG. 5 contains a stepwise variable highest pressure pump. A housing 19 may contain the first pump 30 as in some of the other Figures. But instead of applying a medial pressure gear pump or the like, it is in this embodiment also recommended to use as the first pump in housing 19 one of my variable radial piston pumps, for example of the patents which were mentioned at the description of FIG. 4. Since this pump 30 then can be variable, there is a first pressure range of roughly 1 to 3000 or 5000 psi which is entirely steplessly variable. The variability is often desired, when the primary power source has only a limited capacity. The lower pressure flows shall then be of larger quantity in order to be able to operate a working place with low force but with high speed. The higher pressure stage must then be of lower flow quantity, because otherwise the power source would fail because it has not enough power to operate the bigger pressure range with the big flow rate quantity of the medial pressure range. Since it is not easy and not simple to use the arrangements of the former Figures for a stepless variable operation at the higher pressure ranges, the embodiment of FIG. 5 supplies a partially and stepwise variability of the flow quantity of the highest pressure ranges.

The Figure uses in its embodiment the stepwise connecting and disconnecting of outlets in order to decrease the flow quantity stepwise with ever increasing higher pressure in the higher pressure ranges. The following actual solution is demonstrated in FIG. 5.

FIG. 5 shows nine outlets, namely 21,121,221,321,421,521 621,721 and 821 which are operated by respective cylinder blocks as in the formerly discussed Figures. In the Figure the outlets 21,321 and 621 are combined in housing 19 to a third common flow 82 in outlet line 82. The outlets 121,421 and 721 are combined to a fourth common flow 83 in housing 19 and the outlets 221,521 and 821 are combined in housing 19 to a second common flow 81 in outlet line 81.

Instead of combining each three outlets into one of the common flows, any other plurality or singularity of outlets might be combined to a common outlet flow, depending on actual requirement.

FIG. 5 now shows the following operation in this embodiment of the invention:

A thrust loaded valve 85 is added to the housing 19, for example in a portion 90 thereof and one-endly loaded by thrust means 41 which might be a spring. In the first high-pressure range the pump 30 if one of my mentioned patented variable pumps, will supply the first variable outlet flow of for example, steplessly variable until 4000 psi. At the maximum pressure of the pump 30 the outlet of the first common high pressure outlet flow will be reduced to the defined maximum of quantity of flow at the pressure-maximum of the first outlet flow. This quantity may then be also zero and a respective relief valve may be set at the maximum of pressure of the first outlet flow to protect the mechanical parts of the first outlet flow pump 30 from too high a pressure, which might otherwise disturb the mechanical parts of the first outlet flow pump 30.

As soon as the required pressure rises over the maximum pressure of the first outlet flow the valve 85 still holds the position as shown in the FIG. 5. It now delivers at the second high-pressure outlet flow all outlet lines 81,82,83 through control recesses 85,87,98 and partially through medial bore 186 out of outlet 921. This is the second high pressure outlet stage with the second, now non-variable delivery outlet flow quantity. As soon as the pressure required rises, for example to the maximum pressure of the second high pressure outlet stage, for example 6000 psi, the valve 85 moves leftward against the thrust means or spring 41. Control recess 187 is now meeting control recess 86 and leads now the second outlet flow of line 81 into the low pressure or unloading chamber 89. Unloading chamber 89 may be communicated to the tank or to low pressure space 2 of the machine. The now remaining flows are outlet flows 82 and 83 which now supply through 87,98,921 a reduced flow quantity of the third high pressure delivery stage with a still higher pressure of, for example, 6000 psi to 8000 psi. Valve 85 is a cylindrical valve boby. It is provided in a cylindrical bore in the valve portion 90 and able to reciprocate therein while it closly fits on the inner face of the wall of the bore in valve housing portion 90.

The valve body recesses 86,87 and 98 are annular recesses which extend from the cylindrical outer face of the valve body 85 into the valve body 85. The combined flow lines 81,82 and 83 end in axially from each other spaced inlets 286,386 and 487 in the housing valve portion 90 of the housing 19. The inlets 286,386 and 487 form radially extending annular recesses 286,386 and 487 which radially entirely surround the respective portions of the valve body 85 in order to prevent lateral forces onto the valve body 85. The valve body 85 is thereby able to reciprocate easily in its seat on the inner face of the bore in the valve housing portion 90 even at very high fluid pressure in the recesses. Passages 193 and 293 communicate the space 89 and space 84 to the atmosphere or to a space under substantially low pressure. At the outermost location of the valve body 85, the location which is shown in FIG. 5, the annular recess 86 registers with the radially extending annular recess 286; the annular body recess 87 registers with the radially extending annular recess 386 and the annular recess 98 registers with the radially extending annular recess 487. The axially extending annular control recesses 187 and 188 which are located between neighboring annular valve body recesses 85 and 87 or 87 and 98, are at this location discommunicated from the radially extending recesses 86,87 and 487 because they are now remote from the mentioned radially extending annular recesses of the inlets. Since, however at the movement of the valve body 85 towards the spring 41 a respective control recess 187 or 188 communicates one of the inlets or radially extending recesses 286 or 386 with the unloading passage(s) and space 293,89; the axially extending annular control recesses 187 and 188 of the valve body 85 alternately remain distanced from the radilly extending recesses 286,386 and 487 and communicate alternately one or more of the inlets or radially extending recesses with the unloading passage means 89,293.

When the required pressure reaches the maximum pressure of the third outlet maximum pressure stage, for example, more than the said 8000 psi, the valve 85 moves still further leftward and communicates also control recess 188 with control recess 87 in addition to the already established communication between recesses 86 and 187. The second common outlet flow 82 is now led through recesses 87 and 188 into the unloading chamber 89. Thereby outlet flows 81 and 82 are led to the unloading chamber and are now cut off from the high pressure delivery port 921. The only remaining outlet flow is now the fourth common outlet flow 83. It flows now directly into and out of outlet 921 with the now smallest delivery outlet flow quantity but with the highest pressure range of for example 8000 to 10,000 psi. Thereafter the valve 85 might, if so desired, also act as a relief valve for the highest maximum pressure. That can be done by allowing it to move further leftward after the highest pressure of for example 10,000 psi is reached to communicate also outlet flow 83 to the unloading chamber 89. It is possible by the meeting of recess 88 with the unloading chamber 89.

The pressures of the discussion are samples only. By defining other thrusts, strengths or way-lengths of thruster 41, valve 85 and/or housing portion 90 with the respective control recesses, other ranges of high pressure stages can be defined. Instead of defining a first high pressure flow, second high pressure flow, third high pressure flow and fourth high pressure flow with the respective first to fourth pressure ranges, it is also possible to define any other number of high pressure flows and high pressure ranges. Instead of valve 85 and housing 90 any other suitable control arrangement may be utilized when the rules and aims of the invention are obeyed.

For a fully automatic operation of the principle, the outlet 21 of the first pump 30 may become combined with highest pressure outlet or exit port 921.

FIG. 6 explains in a sectional view through a portion of FIG. 5 that the outlet port 121 is similarly as in the respective other Figures communicated by respective passage 555 to a chamber 5 with a piston 6 therein. A one way valve ball 18 may be provided if so desired. The other ports 21,221,321,421,521,621,721 and 821 are similarly designed as is already known from the respective portions of the description of the preferred embodiments.

What is claimed, is:

1. A hydraulic arrangement, comprising, in combination, a high pressure pump arranged in a housing and a valve body reciprocably arranged in a valve housing portion, wherein said pump is provided with a plurality of working chamber groups with pluralities of individual pistons in individual working chambers of the respective working chamber group while every working chamber group combines the delivery passages of its individual working chambers to a respective common delivery passage of the respective working chamber group, wherein said valve housing portion is provided with a plurality of inlets equal to the number of said common delivery passages with said inlets axially distanced from each other relative to the axis of said valve body while each individual common delivery passage of said common delivery passages is individually and separately communicated to a single inlet of said inlets of said valve housing portion, wherein said valve housing portion is provided with a high pressure delivery exit port and unloading passage means communicated to a space of substantially low pressure while said valve body is subjected to pressure in fluid on one of its axial ends by the rate of pressure of fluid in said high pressure delivery exit port and on its other axial end to a thrusting compressible spring which thrusts with its spring force again said other axial end of said valve body;

wherein said valve housing portion and said valve body are provided with passages and recesses to communicate and discommunicate said individual delivery passages of said chamber groups and said inlets individually and in common at different rates of pressure of said rate of pressure in said high pressure delivery exit port to said high pressure delivery exit port with stepwise variation of the number of inlets and common delivery flows of said inlets and said common delivery passages in dependency of said rate of pressure in said exit port; and an improvement;

wherein said improvement provides in combination;

(a) piston shoes between pistons in said chambers and a cylindrical outer face of an eccentric cam in said pump;

(b) fluid pressure pockets with surrounding and sealing sealing lands around said pockets to provide hydrostatic bearings between said piston shoes and said outer face of said cam;

(c) annular recesses provided from the radial outside into said valve body;

(d) radially extending annular recesses provided radially into said valve housing portion, (e) an axially entending passage through a portion of said valve body, (f) radial bores to individually communicate said annular recesses of said valve body with said axially extending passage; and (g) axially extended annular control recesses provided on said valve body to alternately remain distanced from said radially extending annular recesses and to communicate at least one of said radially extending annular recesses with said unloading passage means;

whereby (a) said radially extending recesses surround that valve body radially to prevent radially directed the valve body laterally displacing and thrusting forces;

(b) said annular recesses of said valve body temporarily register with respective recesses of said radially extending recesses of said valve housing portion for said communication and discommunication of said individually combined flows of fluid of said individaul chambers of said chamber groups, and;

(c) said axially extending passage of said valve body prevents valve body dislocating radial forces, whereby said annular recesses of said housing portion and of said valve body together with said axially extending passage secure the easy reciprocation of said valve body in said housing portion without radially laterally directed forces respective to the axis of said valve body, while said fluid pressure pockets between said piston shoes and said cam secure the capability to deliver fluid under pressure which exceeds three thousand pounds per square inch;

whereby said pump and said valve body in said valve housing portion secure the delivery of rates of pressure which exceed three thousand pounds per square inch through said exit port at different rates of flow which exceed three thousand pounds per square inch when said valve body reciprocates in said valve housing portion and thereby communicates and discommunicates a respective number of said annular recesses of said valve body with a respective number of said radially extending annular recesses of said valve housing portion.

2. The hydraulic arrangement of claim 1;

wherein said pump includes a low pressure flow delivery pump stage which delivers a flow of fluid of less than three thousand pounds per square inch when said valve body is pressed against said spring into its axial outermost location at which all annular recesses of said valve housing potion and of said valve body communicate individually and all of said flows deliver a flow of fluid through said exit port.

3. A hydraulic arrangement of claim 19, with a fluid flow supply pump, a passage arrangement and a valve-arrangement;

wherein said pump supplies fluid to said passage arrangement and through said passage arrangement to said valve arrangement, wherein said passage arrangement includes a plurality of individual separate passages, wherein said pump arrangement includes a plurality of separated individual outlets, wherein said outlets supply flows of fluid separatedly of each each other individually into said individual passages, wherein said valve arrangement includes a valve-housing and a valve-body with said valve housing having individual control ports, which are individually communicated with said individual passages, wherein said valve body includes individual control recesses, wherein said valve arrangement includes a pressure fluid delivery exit port and unloading low pressure exit port which is connected to a space under low pressure, preferably to the fluid tank, wherefrom the said pump sucks said fluid, wherein said valve body is able to move relatively to said valve-housing to connect and disconnect individual control ports and control recesses of said control ports and control recesses, and, wherein said arrangements are used to connect a plurality of said passages to said pressure fluid delivery port at one desired pressure range and to connect a single passage of said passages to said pressure fluid delivery port, while connecting at least one of said passages to said low pressure exit port at an other range of pressure.

4. The arrangement of claim 3, wherein said valve housing contains a bore with said valve body being a cylindrical bar which has said recesses, wherein said valve body is sealingly fitted into said bore and axially moveable therein, and, wherein the axial movment in said arrangement defines said connections,

5. The arrangement of claim 4, wherein said valve body is provided and loaded on one of its axial ends with the a pressing spring, wherein said valve body is subjected on the other end of said axial ends to the fluid pressure supplied by one of said passages and control ports, and, wherein the play of forces on said ends by said spring and said pressure actuates and holds the axial movement and location of said valve body, whereby said valve body communicates and discommunicates the respective control ports and control recesses to lead the respective flow of the respective passage of said passages to said pressure exit port and to said low pressure exit port respectively at the respective pressure range defined by said play of forces on said ends of said valve-body.

* * * * *